United States Patent [19]

Okazaki

[11] Patent Number: 4,683,401

[45] Date of Patent: Jul. 28, 1987

[54] MICROWAVE TUBE OUTPUT SECTION

[75] Inventor: Yukio Okazaki, Yokohama, Japan

[73] Assignee: Kabushiki Kaisha Toshiba, Kawasaki, Japan

[21] Appl. No.: 780,308

[22] Filed: Sep. 26, 1985

[30] Foreign Application Priority Data

Sep. 28, 1984 [JP] Japan ..... 59-203554
Sep. 28, 1984 [JP] Japan ..... 59-146776[U]

[51] Int. Cl.[4] ..... H01J 7/46

[52] U.S. Cl. ..... 315/39; 315/39.51; 315/39.53; 333/230; 333/252

[58] Field of Search ..... 315/39, 39.51, 39.53, 315/5, 13; 333/230, 252

[56] References Cited

U.S. PATENT DOCUMENTS 2,608,673 8/1952 Brown ..... 333/230
3,254,263 5/1966 Nelson ..... 315/39
3,439,296 4/1969 Buckley ..... 333/252
3,448,413 6/1969 Preist et al. ..... 315/39.53
3,701,061 10/1972 Novajovsky et al. ..... 333/252

*Primary Examiner*—Harold Dixon
*Attorney, Agent, or Firm*—Oblon, Fisher, Spivak, McClelland & Maier

[57] ABSTRACT

An output section which takes output by a coaxial line from the output cavity of a microwave tube such as a klystron, and has a structure such that the coaxial line is divided into a coaxial line section continuous with the output cavity, and a coaxial line section including a dielectric air-tight ring which is fastened so as to be vacuum-tight between the internal and external conductors, and with the internal and external conductors of these divided coaxial line sections each joined so as to be air-tight by thin weld rings. The output section obtained is easy to manufacture, has high reliability, and is applicable to high power usage.

9 Claims, 5 Drawing Figures

MICROWAVE TUBE OUTPUT SECTION

BACKGROUND OF THE INVENTION

1. Field of the Invention

This invention relates to an output section of microwave tubes such as klystrons and traveling-wave tubes.

2. Background of the Prior Art

One type of structure for the output section of microwave tubes such as klystrons is to have a rectangular waveguide joined to the end of a coaxial line which is connected to the output cavity. A vacuum-tight aperture made of a ceramic dielectric is set up in part of the waveguide. Alternatively, a dielectric air-tight wall may be set up partway along the coaxial line section {U.S. Pat. No. 3,254,263 (Nelson) and Japanese Patent Laid open No. 56-42097}. In the former case, however, there is the problem that after the tube evacuation, it is almost impossible to adjust the coupling characteristics between the coaxial line and the waveguide especially for high power level. In the latter case, also, it is extremely difficult to make a structure which adequately resists multipactor phenomena and thermal stress on the dielectric air-tight wall. For these reasons, existing structures have the limitation that they cannot handle high power levels.

SUMMARY OF THE INVENTION

One object of this invention is to provide a microwave tube output section with a structure that is easy to assemble, adequately resists high power levels, and solves difficultiese such as those described above. Another object of this invention is to provide a simple microwave tube output section structure which allows the connection of various output waveguides, and which allows easy adjustment of the coupling characteristics between the coaxial line and the output waveguide according to requirements, after the evacuation of the tube.

This invention is characterized in that in a microwave tube put section possessing a dielectric air-tight ring attached between the outside wall of the internal conductor and the inside wall of the external conductor of a coaxial line section having an internal and an external conductor joined to the output cavity of, for instance, a klystron, the internal conductor and external conductor are each divided in the line axis of the coaxial line section at a position inside, i.e., on the output cavity side of, that of the dielectric air-tight ring, thin weld rings are joined to each conductor wall of these divided sections, these thin weld rings are welded together so as to be air-tight, and in addition the conductor walls of these divided sections electrically contact each other out. In this way, since the joining of the dielectric air-tight ring attached between the internal and external conductors allows manufacture as a single unit, a structure with a sufficiently high reliability can be assembled, and this can be done on the basis of the minimum necessary evacuation of the tube itself. Accordingly, a microwave tube output section which can resist comparatively high power levels can be obtained. In addition, by making the end section of the internal conductor divisible into components at a position outside that where the dielectric air-tight ring is attached, an output section is obtained which can be installed or exchanged after evacuation of the tube.

By doing this, the evacuation of the tube can be done for the minimum necessary vacuum area. The internal conductor end section can be fitted or exchanged according to requirements and the required output characteristics can be obtained after its evacuation. Accordingly, the required output coupling characteristics can be obtained by using various shapes and sizes of output waveguides coupled with this output section.

DETAILED DESCRIPTION OF THE PREFERRED EMBODIMENT

Figure 1:
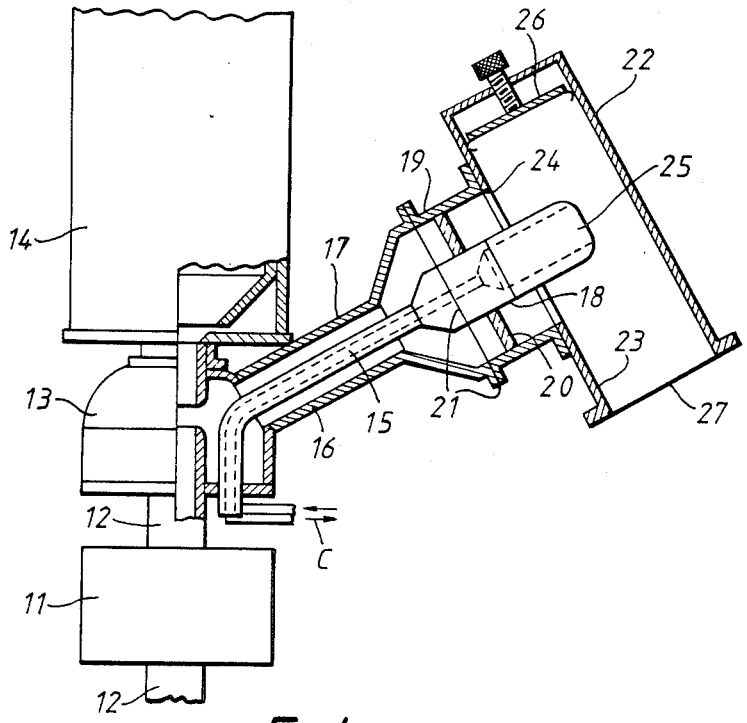
FIG. 1 is a cross sectional view showing an outline of an embodiment of the invention.

An embodiment of the invention is described below with reference to the drawings. Similar components are shown by the same symbols. Firstly, an outline structure of a sample application of the invention to a klystron is described using FIG. 1. Components of the klystron tube, the intermediate resonant cavity 11, drift tube 12, output cavity 13 and collector 14 are arranged vertically along the axis of the tube. A coaxial line section 17, comprising an internal conductor 15 and an external conductor 16, is coupled to part of the cavity wall of output cavity 13, and coolant is circulated in internal conductor 15, as shown by the arrows (C). The internal and external conductor both increase in diameter partway along, becoming the internal conductor large diameter section 18, and the external conductor large diameter section 19 respectively. A dielectric air-tight ring 20 is fixed so that it is vacuum tight between the two conductors at the large diameter section. Both conductors are split into components in the direction of the axis as described below at the division 21 which is positioned further inside than the air-tight ring 20, and when the tube is complete, it is solidly coupled both electrically and in terms of vacuum-tightness.

A rectangular output waveguide 22, which is connected to an external load, is conected to this type of klystron output section. That is to say, the longer face 23, of rectangular waveguide 22 is connected to the end flange of external conductor large diameter section 19. The end section 25 of internal conductor large diameter section 18 protrudes to a fixed length only into the waveguide from coupling hole 24 in the wavguide. At one end of waveguide 22, there is a moveable short 26, and the other, waveguide flange 27 is connected to an external circuit. There is an internal conductor division 28 on the internal conductor large diameter section at a point further out than the position where dielectric air-tight ring 20 has an air-tight joint, that is to say, toward the end of the internal conductor. This produces a structure which allows internal conductor end section 25 to be fitted or exchanged after the evacuation of the tube. In this manner, output cavity 13 and the space inside coaxial line section 17 as far as dielectric air-tight ring 20 are taken as the vacuum area. Coolant circulates within interal conductor 15 and its large diameter section 18. As described below, the external conductor also has a structure which allows the circulation of coolant.

Figure 2:
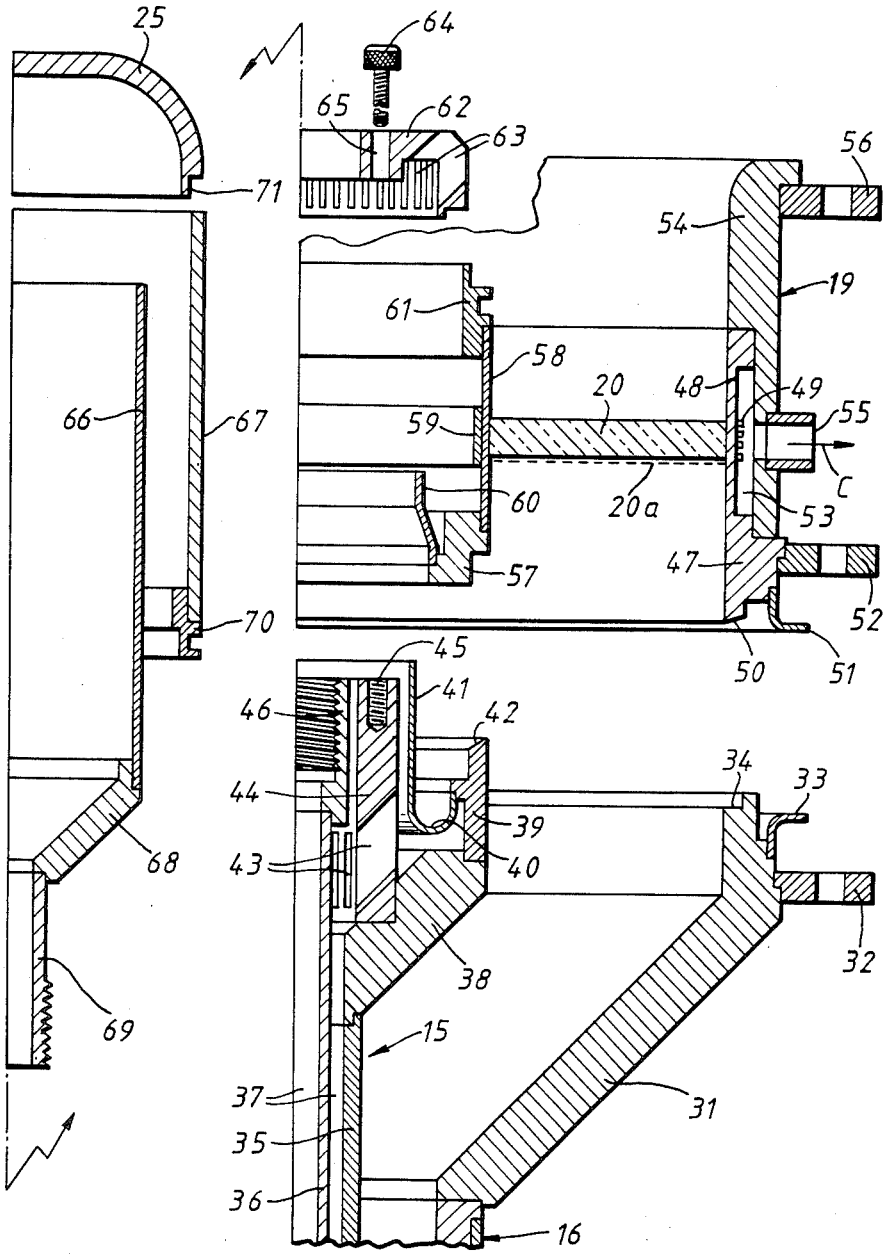
FIG. 2 is a longitudinal cross sectional view of a broken down half-section of its essential parts.
Figure 3:
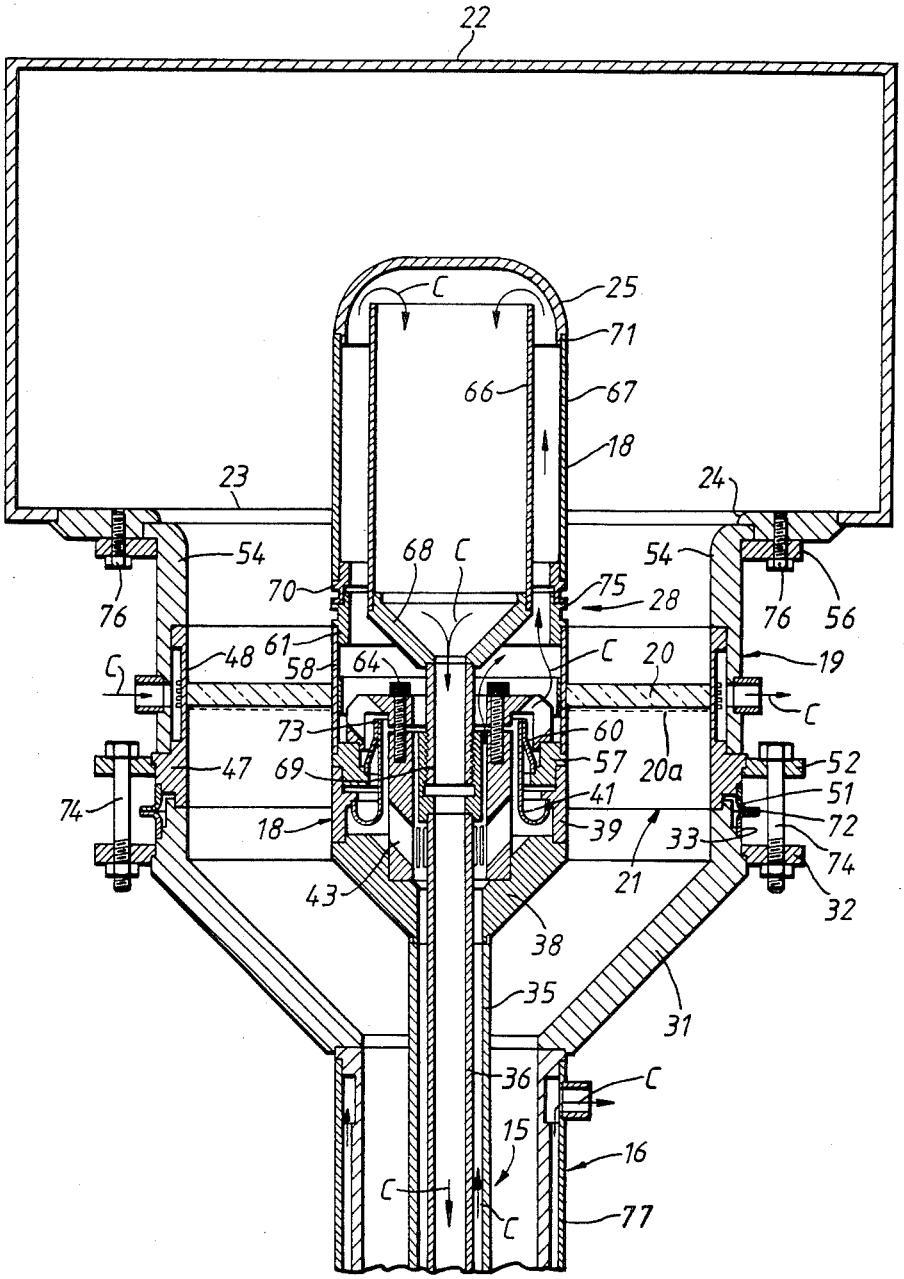
FIG. 3 is a longitudinal cross sectional view of the essential parts of the embodiment of the FIG. 1.

Next, the structure of the output section will be described in its preferred order of assembly using FIG. 2 and FIG. 3. FIG. 2 is a broken down half-section of the essential parts to explain the order of assembly, and FIG. 3 is a vertical section showing the completed structure. Firstly, the external conductor 16 of coaxial line section 17 connected to the klystron output cavity has, after an elongated section with a fixed diameter, an external conductor funnel-shaped section 31 which changes into large diameter section 19. No. 1 flange 32 and external conductor No. 1 thin weld ring 33 are soldered on at the open end of the large diameter section, and an indentation for the external conductor contact is made on the end surface. Internal conductor 15 is set coaxially on the inside of this external conductor. This comprises the internal conductor outer tube 35 and internal conductor inner tube 36, with a coolant path 37 inside. An internal conductor funnel section 38 is joined to internal conductor tube 35, and a connecting ring 39 for the internal conductor is joined to its end. To the inside of this internal conductor connecting ring 39 is joined an internal conductor No. 1 thin weld ring 41 with a U-shaped half-section 40, and a contact edge 42 is formed at its end. An outer tube cylinder 44, with many diagonal slits 43 in part of it is joined to funnel-shaped section 38 of the internal conductor, and several screw holes 45 are formed at the end. An inner tube screw cylinder 46 having a female screw thread is joined to the end of the internal conductor inner tube. The structure above is assembled and then fixed as a unit to the output cavity.

The section with dielectric air-tight ring 20 is assembled as a separate structure from this as follows. A thin outside wall 48 of an external conductor connecting ring 47 is given air air-tight join to the outside edge of ceramic dielectric air-tight ring 20, and several Molybdenum (Mo) external reinforcement rings 49 are wrapped around the outside. The bottom edge of external conductor connecting ring 47 has a tapered edge 50 for external conductor contact, and an external conductor No. 2 thin weld ring 51 and a No. 2 flange 52 are brazed onto the outside. External conductor connecting ring 47 is joined to external conductor end cylinder 54 so as to form a ring-shaped coolant chamber 53 around thin outer wall 48, and the coolant pipe 55 is fitted to part of this. No. 3 flange 56 is fitted to the end section of cylinder 54 above. A thin inner wall 58 joined to an inner conductor connecting ring 57 is given an air-tight joint to the inner edge of the dielectric air-tight ring 20, and a molybdenum reinforcing ring 59 is positioned inside it. A cylindrical internal conductor No. 2 thin weld ring 60 is brazed to the inside of the internal conductor connecting ring 57, and an internal conductor No. 1 weld ring 61 is joined to the top end of thin inner wall 58. A TiN multipactor suppression coating layer 20*a* is applied to the vacuum side of dielectric air-tight ring 20. (K. M. Welch "New materials and technology for suppression of RF multipactor" 1974 IEEE International Electron Devices Meeting Technical Digest.) As described above, these structure are assembled as a single unit.

In this way, the section with the dielectric air-tight ring joined in an air-tight way between the internal and external conductors can be assembled separately from the tube as a single structure. Hence, high reliability can be readily achieved for the air-tight joints at the inner and outer edges of the dielectric air-tight ring, and for the application of the multipactor suppression coating layer. Moreover, because high frequency current does not flow through the air-tight joints formed by the external conductor thin weld rings 33, 51 and the internal conductor thin weld rings 41, 60, there is little possibility of these joints being damaged. The internal and external conductor walls are constructed so that high frequency current can actually flow through the space between them, through the external conductor connecting rings 34, 47 and internal conductor connecting rings 57, 42. Because of this, the structure can sufficiently withstand high power microwave transmission. In addition, because cooling of the air-tight joint made by the internal conductor thin weld rings and the dielectric air-tight ring joints can be ensured, reliability is excellent. Also, because the dielectric air-tight ring is attached to the large diameter section of the coaxial line, high frequency electric field in the dielectric air-tight ring is reduced, preventing damage due to discharge and thermal stress.

A press ring 62 is prepared separately from the above structure. This press ring 62 has many diagonal slits 63, and several bolt holes 65 for the insertion of bolts 64. Internal conductor end section 25 having an inner tube cylinder 66 and an outer tube cylinder 67 is also prepared separately. An inner tube funnel-shaped section 68 is attached to the bottom end of inner tube cylinder 66, and an inner tube screw cylinder 69 which has a female screw thread is joined to it. Internal conductor No. 2 weld ring 70 is joined to the bottom end of outer tube cylinder 67. Internal conductor end section 25 is joined to the top end of outer tube cylinder 67 at an outer tube connecting section 71 by brazing.

For the assembly of the tube, as described above, the structure from the klystron output cavity to funnel-shaped section 31, 38 of internal and external conductors in coaxial section 17 is asssembled as a single structure, and the structure containing dielectric air-tight ring section 20 is coupled to it. That is to say, at large diameter section 19 of the external conductor, external conductor No. 1 thin weld ring 33 on external conductor funnel-shaped section 31 and external conductor No. 2 thin weld ring 51 on external conductor connecting ring 47 are brought together, and their edges are sealed by argon-arc welding. Similarly, at large diameter section 18 of the internal conductor, internal conductor No. 1 thin weld ring 41 on internal conductor funnel-shaped section 38 and internal conductor No. 2 thin weld ring 60 on internal conductor connecting ring 57 are brought together and their edges are welded by argon-arc welding. These air-tight joints are denoted respectively by 72 and 73. Next, external conductor No. 1 flange 32 and No. 2 flange 52 are clamped together by several clamping bolts 74, and on the internal conductor side, press ring 62 is inserted from above until it reaches internal conductor connecting ring 57, and is fastened on by screwing bolts 64 into bolt screw holes 45 in outer tube cylinder 44. By doing this, exteral conductor connecting indentation section 34 and external conductor connecting tapered section 50, large diameter sections of the external conductor, and also internal conductor connecting ring 57 and tapered section 42, large diameter sections of the internal conductor, are brought together over their whole circumference, forming electrical contacts. By making the external dimensions of internal conductor 15 larger than the internal diameter of external conductor 16, dielectric air-tight ring 20 is not directly exposed to the electron beam from output cavity 13. This prevents difficulties being caused by some of the electrons reaching dielectric air-tight ring 20 through coaxial line 17.

At this stage, the space from the output cavity to funnel-shaped section 31 of the external conductor and funnel-shaped section 38 of coaxial line section 17 as far as the dielectric air-tight ring forms an air-tight vacuum container. After the evacuation process, inner screw cylinder 69 of inner tube screw cylinder 66 are screwed into inner tube screw cylinder 46. Next, outer tube cylinder 67, which forms part of the large diameter section of the internal conductor, is joined at arc weld section 75 so that internal conductor No. 2 weld ring 70 comes together with internal conductor No. 1 weld ring 61, forming a single structure from the internal conductor and internal conductor end section 25. This completes the assembly of the output section. For the connection of the output waveguide, coupling aperture 24 of waveguide 22 is brought together with No. 3 flange 56 of external conductor cylinder end 54, and coupled with bolts 76. In operation, coolant is circulated, as shown by various arrows (C), through a coolant path 77 of the external conductor, coolant path 37 of the internal conductor, and through coolant chamber 53 around dielectric air-tight ring 20. Specifically, in the internal conductor, the coolant flows mainly through slits 43 in outer cylinder 44, sufficiently cools internal conductor thin weld rings 41, 60, positioned inside the coolant circulation path, passes through slits 63 in press ring 62, cools thin inside wall 58, outer tube cylinder 67 and the internal conductor end section, flows into inner tube cylinder 66, and is discharged to the outside through internal conductor inner tube 36.

It is also possible to have a structure whereby a large diameter section is not formed in coaxial line section 17, and the internal conductor is divided at a position outside that of dielectric air-tight ring 20, allowing fitting and exchange of the internal conductor end section whenever necessary. In this case, however, it is preferable to prevent electrons from reaching dielectric air-tight ring 20 by, for example, bending the coaxial line section.

Figure 4:
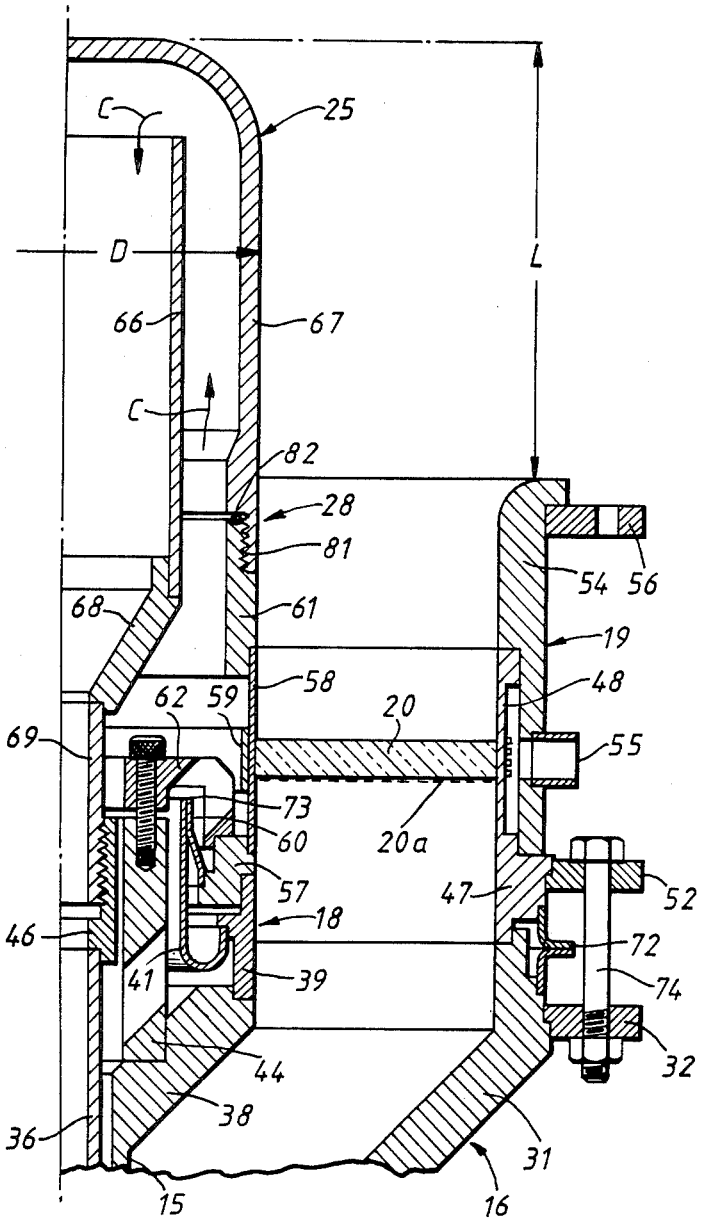
FIG. 4 is a longitudinal cross sectional view of the essential parts of the other embodiment of the invention.

In the embodiment shown in FIG. 4, cup-shaped internal conductor end section 25 is coupled so that it can be removed and refitted by screwing it on at a position outside that of dielectric air-tight ring 20 with a screw section 81. An O-ring 82 is added on the inside to form a water-tight seal. By this method, the diameter(D) and length(L) of projection from the end of the external conductor can be altered according to requirements simply by exchanging the internal conductor end section at screw section 81.

Figure 5:
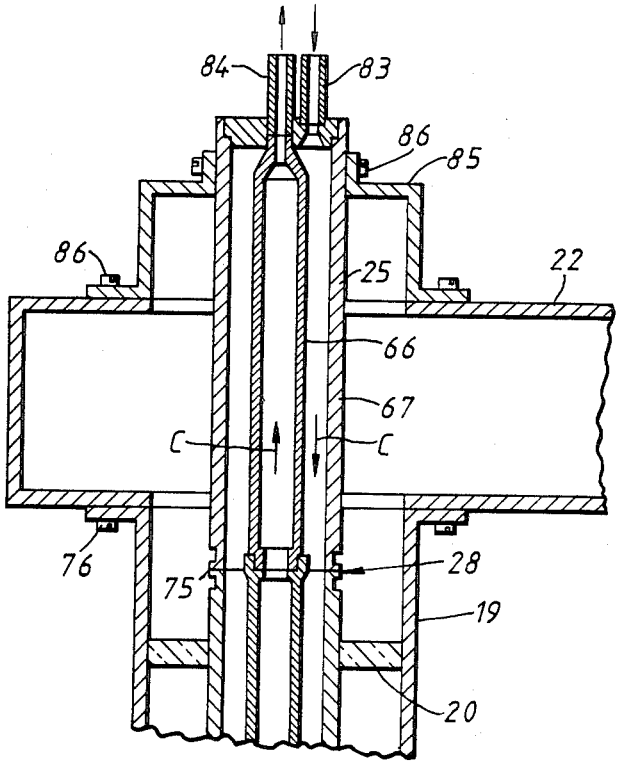
FIG. 5 is a longitudinal cross sectional view of the essential parts of the other embodiment of the invention.

The embodiment shown in FIG. 5 has outer tube cylinder 67 of the internal conductor end section made even longer, with pipes 83, 85 for the supply and discharge of coolant at its end. Outer tube cylinder 67 is coupled by welding at a position outside that of dielectric air-tight ring 20. This output section has a coaxial waveguide section 85 protruding from the opposite face of the output waveguide so that it coaxially surrounds the internal conductor end section, and so that its bottom is electrically coupled with the outer tube cylinder 67, 86 are the fastening bolts. In this case also, internal conductor end section 25 with the required length to correspond to the characteristics of the output waveguide can be fitted.

The invention having the above configuration is formed with the coaxial line section having a division into 2 coaxial line divided blocks in the line axis direction at a position inside, i.e., on the output cavity side of, that where the dielectric air-tight ring is attached in an air-tight manner between the outer wall of the internal conductor and the inner wall of the external conductor. Since the thin weld rings joined to each of the conductor walls at the division point are welded so as to be air-tight, the block on the side of the dielectric air-tight ring forming an air-tight joint between the internal and external conductors can be assembled as a single unit independent of the tube. Because of this, an extremely reliable joint structure can be easily achieved for each of the air-tight joint sections. In particular, high reliability can be easily achieved for the air-tight joint sections at the inside and outside edges of the dielectric ring, and the application of the multipactor suppression coating layer. Moreover, because high frequency current does not flow through the air-tight joints formed by the external conductor thin weld rings and the internal conductor thin weld rings, these rings are free from the damage by high frequency loss. The internal and external conductor walls are constructed so that high frequency current can actually flow through them, through the external conductor connecting ring and internal conductor connecting rings. Because of this, the structure can adequately withstand high power microwave transmission. In addition, because cooling of the air-tight joint made by the internal conductor thin weld rings and the dielectric air-tight joints can be ensured, reliability is excellent. Also, because the dielectric air-tight ring is attached to the large diameter section of the coaxial line, high frequency electric field density in the dielectric air-tight ring is reduced, preventing damage due to electric discharge and thermal stress, and moreover, prevention of part of the electron beam reaching the dielectric air-tight ring is ensured. Accordingly, because the coaxial line section can be made to be straight, each component shape is simple and easy to assemble. Moreover, an internal conductor end section with length, thickness and shape corresponding to the requirements of the output waveguide can be connected after evacuation of the tube, and fine adjustment of the coupling characteristics can also be easily carried out. This is a remarkable advantage for the output section of this type.

What is claimed is:

1. A microwave tube output section in a microwave tube having an output cavity which can maintain a vacuum inside, comprising:

a coaxial line section having an internal conductor and an external conductor coupled to said output cavity; and a dielectric air-tight ring which is attached so as to be vacuum-tight between an outer wall of the internal conductor and an inner wall of the external conductor of the coaxial line section;

wherein the internal conductor is cylindrical, and is divided into two parts at a position on the output cavity side of the dielectric air-tight ring in the coaxial line, each of said two parts including thin weld rings attached to respective inner walls of the two parts of the divided internal conductor, these thin weld rings being welded together so as to be air-tight; and wherein the external conductor is divided into two parts at a position on the output cavity side of the dielectric ring in the coaxial line, each of said two parts of the external conductor including thin weld rings attached to outer walls of the two parts of the divided external conductor, said thin weld rings of the external conductor parts being welded together so as to be air-tight, and the two parts of the respective conductors each mutually electrically contacting.

2. A microwave tube output section according to claim 1, characterized in that in the coaxial line section the internal conductor and external conductor both increase in diameter, and the dielectric air-tight ring and the thin weld rings of the divided sections are attached so as to form air-tight seals in the large diameter section.

3. A microwave tube output section according to claim 1 characterized in that the internal conductor is constructed so that coolant can be circulated within it.

4. A microwave tube output section according to claim 1 characterized in that a multipactor suppression coating layer is formed on the surface of the dielectric air-tight ring on the output cavity side.

5. A microwave tube output section according to claim 1 characterized in that the internal conductor end section is connected, at a position on the outside of the position where the dielectric air-tight ring is attached, in such a way that it can be exchanged.

6. A microwave tube output section according to claim 1 characterized in that the internal conductor and external conductor of the coaxial line section both increase in diameter close to the outside end, with the dielectric air-tight ring being attached so as to form a vacuum-tight joint on the large diameter section, and the end section of the large diameter section of the internal conductor is connected in such a way that it can be exchanged.

7. A microwave tube output section according to claim 5 characterized in that the internal conductor inside wall with thin weld rings are in the coolant path.

8. A microwave tube output section according to claim 1 characterized in that the facing edges of the divided internal conductor are pressed firmly together in such a way that the conductor walls mutually contact electrically.

9. A microwave tube output section according to claim 1 characterized in that it has a first coaxial line block in which the coaxial line section is elongated from the output cavity, and a second coaxial line block which includes the dielectric air-tight ring, and that an air-tight seal is made by means of the thin weld rings which join both the internal and external conductors at the section where these coaxial line blocks come together.

* * * * *